US005489151A

United States Patent [19]

Weber

[11] Patent Number: 5,489,151

[45] Date of Patent: Feb. 6, 1996

[54] PORTABLE MIXING DEVICE FOR USE WITH FLUID CONTAINER HAVING THREADED OPENING

[75] Inventor: Joseph A. Weber, Frisco, Tex.

[73] Assignee: Uniroyal Chemical Company, Inc., Middlebury, Conn.

[21] Appl. No.: 339,037

[22] Filed: Nov. 14, 1994

[51] Int. Cl.[6] ..... B01F 7/20

[52] U.S. Cl. ..... 366/247; 366/308

[58] Field of Search ..... 366/129, 130, 366/244–245, 247, 249–251, 308, 326, 330, 331, 342, 343, 605; 416/69, 70 R, 72, 73, 76, 142, 143, 131, 205

[56] References Cited

U.S. PATENT DOCUMENTS

| | | | |
|---|---|---|---|
| 1,447,653 | 3/1923 | Fish . | |
| 1,711,114 | 4/1929 | Hunt | 416/142 |
| 1,734,120 | 11/1929 | Farrington . | |
| 1,827,004 | 10/1931 | Gibson . | |
| 1,841,435 | 1/1932 | Gibson . | |
| 2,146,372 | 2/1939 | Ingraham | 366/331 |
| 2,469,557 | 5/1949 | Ingraham et al. | 366/331 |
| 2,493,210 | 1/1950 | Woodman | 366/247 |
| 2,543,151 | 2/1951 | Cerniak | 366/605 X |
| 2,579,874 | 12/1951 | Shaw | 366/247 |
| 3,132,850 | 5/1964 | Puchalski . | |
| 3,322,403 | 5/1967 | Murphy | 366/247 |
| 3,559,962 | 2/1971 | Enssle et al. . | |
| 4,981,367 | 1/1991 | Brazelton . | |
| 5,193,908 | 3/1993 | Rescorla et al. | 366/247 X |
| 5,282,681 | 2/1994 | Supelak . | |

FOREIGN PATENT DOCUMENTS

| | | | |
|---|---|---|---|
| 60-179127 | 9/1985 | Japan | 366/308 |

*Primary Examiner*—Charles E. Cooley
*Attorney, Agent, or Firm*—Jerome D. Drabiak

[57] ABSTRACT

A portable fluid-mixing device. The fluid-mixing device comprises a container insert, an elongated shaft, a one-piece propeller, a wrench, a jam nut, and a crank. External threads of the insert are removably engageable with internal threads of an opening of a conventional 55-gallon drum. The propeller is pivotally connected to an end portion of the shaft. The wrench defines an annular surface and has external threads which are mated to internal threads of the insert. The jam nut defines an annular shoulder which is engageable by the wrench annular surface and has internal threads which are mated to the external threads of the insert, for bringing the insert into fluid-tight engagement with the drum opening. The crank, removably engageable with the shaft at the insert-carried end portion of the shaft, is used by an operator to manually rotate the propeller in the drum.

8 Claims, 3 Drawing Sheets

FIG. 3
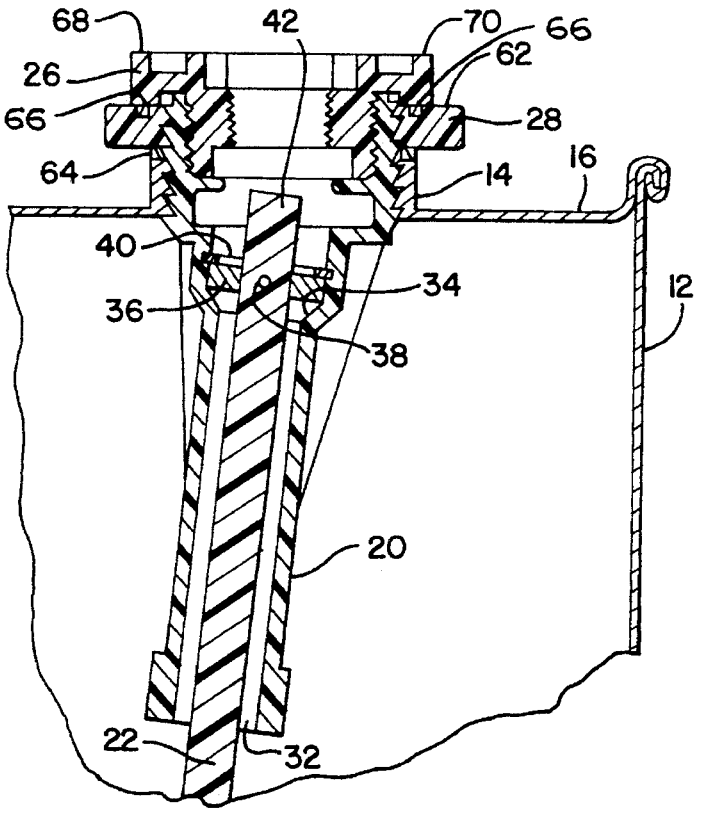
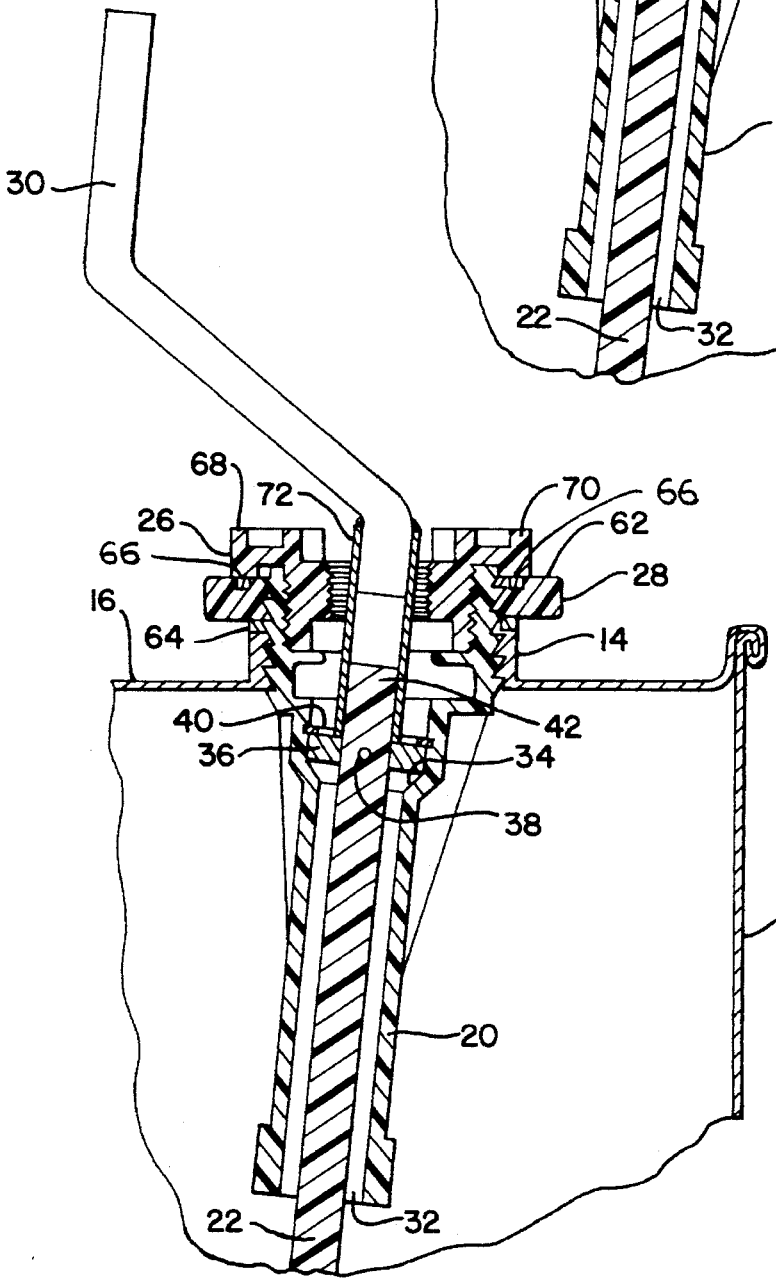
FIG. 4

PORTABLE MIXING DEVICE FOR USE WITH FLUID CONTAINER HAVING THREADED OPENING

TECHNICAL FIELD OF THE INVENTION

This invention is generally directed to the technical field of portable mixing devices.

The portable mixing device of the present invention is human powered and especially designed to be used in combination with a 55-gallon drum having a threaded opening (i.e. "bung") of conventional dimension.

1. Background Of The Invention

While impeller or mixing element design may become a consideration in the overall development of a particular advance in the fluid-mixing art, the more complex designs are presently not universally favored. (See, e.g., U.S. Pat. No. 3,132,850 to Puchalski; U.S. Pat. No. 3,559,962 to Enssle et al.; and U.S. Pat. No. 4,981,367 to Brazelton.)

For example, portable mixers for fluid containers such as 55-gallon drums may require a utility source such as pressurized air or electrical power to effect fluid mixing, as is respectively illustrated in U.S. Pat. No. 3,559,962 to Enssle et al. and in U.S. Pat. No. 4,981,367 to Brazelton. However, utility-source "shut downs" occasionally occur. Moreover, utility sources such as pressurized air and electrical power are not always available at remote locations.

Indeed, the oft-heard saying "simpler is better" seems again to have fallen into favor in connection with the design of impellers or mixing elements used to effect simple mixing of fluids contained within vessels such as 55-gallon drums.

It is thus becoming increasingly more desirable to have a portable mixing device that relies upon neither a pressurized air source nor an electrical power source. In certain situations it is most desirable to have available a portable mixing device that is human powered.

Human-powered portable fluid-mixing devices have long been known. (See, e.g., U.S. Pat. No. 1,447,653 to Fish; U.S. Pat. No. 1,734,120 to Farrington; and U.S. Pat. Nos. 1,827,004 and 1,841,435—both to Gibson.)

However, known human-powered portable fluid-mixing devices have certain inconveniences and pose certain problems.

For example, in U.S. Pat. No. 1,447,653 to Fish the shaft is of one-piece design. As a result, the barrels cannot safely be stacked vertically until after the propeller, shaft and plug assembly are first removed from the barrel.

Also, continued re-insertion of the lower end of the mixing rod into a particular barrel is almost certain to have the sharpened portion of the lower end of the mixing rod ultimately cause damage to the bottom "head" of the barrel.

In U.S. Pat. No. 1,734,120 to Farrington, it is necessary first to remove the mixing device from the drum before the drum plug can be re-inserted into the drum collar, whenever it is desirable to prevent splashing or vaporization of the drum contents during drum movement or storage.

In U.S. Pat. Nos. 1,827,004 and 1,841,435 to Gibson there is shown an elongated bushing or sleeve which threadedly engages the opening of the illustrated drum.

However, because there is no disclosure or even a suggestion in either U.S. Pat. No. 1,827,004 or U.S. Pat. No. 1,841,435 that the sleeve structure shown and discussed would or even could serve to function as a wrench, a special tool such as a wrench will always be necessary whenever it is necessary either to brined the bushing or sleeve into fluid-tight relationship with the threaded opening of the illustrated drum or to remove the bushing or sleeve from the threaded opening of the illustrated drum, at times when these elements or components are jointed together in a fluid-tight relationship.

2. Objects Of The Invention

One object of my present invention, therefore, is to provide for efficient mixing of fluid contained within a conventional 55-gallon drum, wherein the fluid-mixing device is relatively simple in design and operation.

Yet another object of my invention is to provide a portable mixer for a conventional 55-gallon fluid-containing drum, wherein neither pressurized air nor electrical power is required to effect efficient fluid mixing of the drum contents.

Still another object is that 55-gallon drums equipped with my fluid-mixing device be able to have the fluid-mixing device removed from the drum, without the need for special tools, so that drums can be stored safely, as needed.

SUMMARY OF THE INVENTION

Briefly, and in accordance with the foregoing objects, the novel, portable fluid-mixing device of my present invention will now be summarized. The mixing device comprises a container or drum insert, an elongated shaft, a one-piece propeller, a wrench, a jam nut, and a crank.

The container insert has internal threads and external threads. The external threads of the insert are mated to internal threads of a fluid container having a conventionally-threaded opening. The external threads of the insert are removably engageable with the internal threads of the fluid container.

The elongated shaft is rotatably carried by the insert. The shaft defines a shaft axis and has an end portion that is non-circular in transverse cross section.

The one-piece propeller is pivotally connected to the opposite end portion of the shaft. The one-piece propeller is pivotable about a pivot point that is spaced from the shaft axis. The propeller is rotatable about the shaft axis.

The wrench and the jam nut are both carried by the insert. The wrench defines an annular surface and has external threads which are mated to the internal threads of the insert. The jam nut defines an annular shoulder which is engageable by the wrench annular surface and has internal threads which are mated to the external threads of the insert, for bringing the insert into fluid-tight engagement with the container opening.

The crank is removably engageable with the shaft at the insert-carried end portion of the shaft, for rotating the shaft about the shaft axis.

BRIEF DESCRIPTION OF THE DRAWINGS

The foregoing, as well as other objects, features and advantages of my present invention will become more readily understood upon making reference to the detailed description and accompanying drawing figures, wherein:

FIG. 3 is another partially-fragmented view of the drum shown in FIG. 1, on an enlarged scale relative to FIGS. 1 and 2, illustrating the functionally co-operative relationship of certain elements or components of the portable mixing device of my present invention.

FIG. 4 is yet another partially-fragmented view of the drum shown in FIG. 1, on a scale similar to that of FIG. 3, illustrating the co-operative functional relationship of an additional element or component of the portable mixing device of my present invention.

Throughout the figures, like reference numerals refer to like elements.

DETAILED DESCRIPTION OF THE PREFERRED EMBODIMENT

Figure 1:
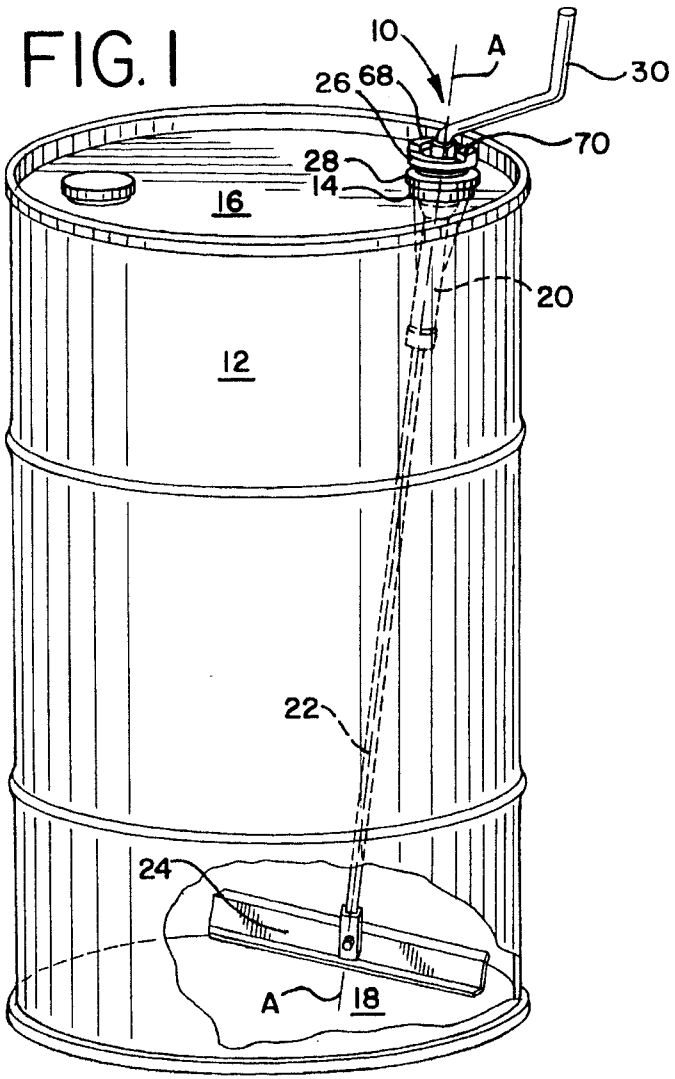
FIG. 1 is a perspective view of a conventional 55-gallon drum equipped with the portable mixing device of my present invention.

Referring now to FIG. 1, there is shown a preferred embodiment of the portable mixing device 10 of my present invention.

Mixing device 10 is designed to be used in combination with a fluid container, a preferred fluid container being the illustrated 55-gallon drum 12 of conventional design. Drum 12 has an internally-threaded opening 14.

Drum opening 14 is formed in a circular, upper end 16 of drum 12, offset from the center of upper end 16. Drum 12 includes a bottom end 18 which is opposite upper end 16.

Figure 5:
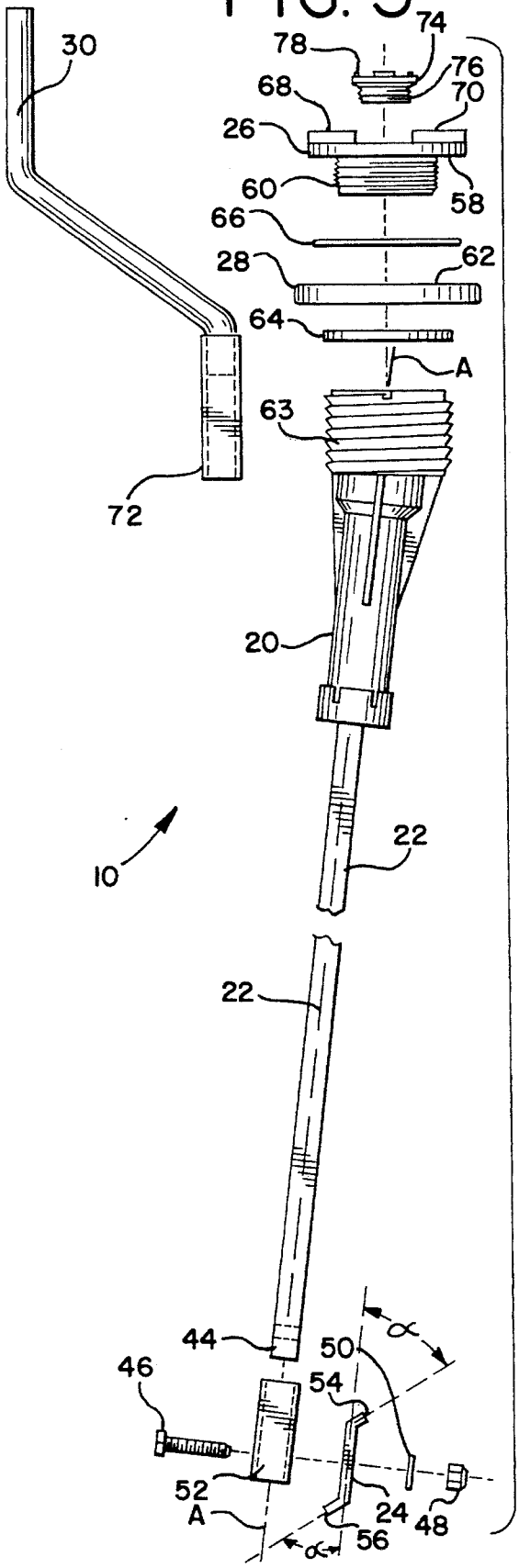
FIG. 5 is an exploded, partially-fragmented front elevational view, on an enlarged scale relative to FIG. 1, presenting the various elements or components of the portable mixing device of my present invention.

Referring next to FIG. 5, the portable mixing device 10 is seen to comprise a container insert 20, an elongated shaft 22, a one-piece propeller 24, a wrench 26, a jam nut 28, and a crank 30.

Referring briefly to FIGS. 3 and 4, an end portion of container insert 20 is seen to include both internal threads and external threads.

The external threads of the container insert 20 are designed to rotatably engage (i.e. "mesh with") the internal threads of the conventionally-threaded opening 14 of drum 12.

The external threads of insert 20 are designed to be readily rotatably engageable with, and readily removable from, the internal threads of drum opening 14 when rotating drum insert 20 relative to drum opening 14, while the external threads of insert 20 are in meshing engagement with the internal threads of opening 14.

Shaft 22 is rotatably carried by insert 20. In particular, referring briefly to FIGS. 3 and 4, insert 20 is seen to define a through bore 32 which includes a lesser diameter portion, a greater diameter portion, and an inner shoulder portion 34 which serves to join together smoothly the inner surfaces of the greater and lesser diameter portions of through bore 32.

A washer 36 is fastened to an end portion of shaft 22 by conventional fastener means 38.

Washer 36 and through bore 32 are both circular in cross section. The inside diameter of the upper portion of through bore 32 is slightly greater than the diameter of washer 36, enabling washer 36 to rotate relative to insert 20 within the upper portion of through bore 32.

The inside diameter of the lower portion of through bore 32, however, is less than the diameter of washer 36.

The upper portion of through bore 32 further includes an inner circumferential slot or groove into which is fitted a removable spring clip 40 which abuttingly engages washer 36, the shoulder 34 and spring clip 40 both thereby serving to retain washer 36 in bore 32 adjacent shoulder 34, enabling shaft 22 to be rotatable in bore 32 relative to insert 20.

As described above, washer 36 which has a circumferential portion that is rotatably engageable with an inner circumferential portion of the through bore 32 of drum insert 20 thus functions as a bearing for shaft 22 within the through bore 32 of drum insert 20, thereby enabling shaft 22 to be rotated about shaft 22 relative to drum insert 20.

Shaft 22 defines a shaft axis A—A (FIGS. 1 and 5); and shaft 22 has an end portion 42 that is non-circular in cross section. (FIG. 3.) In particular, shaft end portion 42 is preferably square-shaped in transverse cross section.

Figure 6:
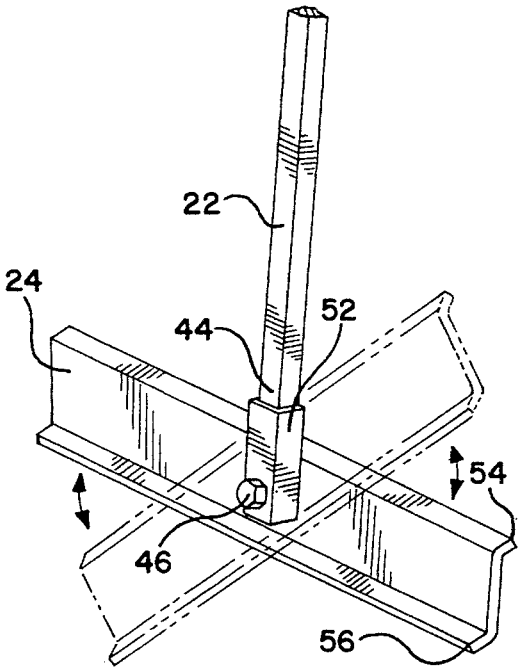
FIG. 6 is a partially-fragmented, perspective view of the propeller-mounted end of the mixing device shaft, illustrating the pivotable relationship of the one-piece propeller relative to the shaft.

The one-piece propeller 24, preferably elongated (FIGS. 1 and 6), is removably pivotally connected to the opposite end portion 44 of shaft 22 by conventional fastener means 46 which includes a nut 48 and lock washer 50.

In particular, as shown in FIG. 5, shaft end portion 44 includes a transverse through bore dimensioned to receive the threaded shank portion of fastener 46. A sleeve 52, internally dimensioned to receive shaft end portion 44, also includes a transverse through bore dimensioned to align with the transverse bore through shaft end portion 44 and to receive the threaded shank portion of fastener 46.

When sleeve 52 is fitted onto shaft end portion 44, with their respective through bores aligned, the shank portion of fastener 46 is disposed into the aligned bores with an end of the shank portion of fastener 46 extending therefrom. The shank portion of fastener 46 is of sufficient length such that the propeller 24, the washer 50 and the nut 48 fit onto the shank end portion of fastener 46, enabling the one-piece propeller 24 to pivot about the shank portion of fastener 46.

The elongated one-piece propeller 24, of generally planar configuration (FIG. 6), includes integral longitudinal edge portions 54 and 56 which are disposed by angle alpha ($\alpha$), FIG. 5, from the planar surface of propeller 24.

The one-piece propeller 24, pivotable about the shank portion of fastener 46 (see FIG. 6), is thus partially rotatable (due to the interference of propeller longitudinal edge portions 54 and 56 with shaft end portion 44) about the shank portion of fastener 46 relative to shaft 22.

In operation, propeller 24 is thus fixed to shaft 22 at a pivot point that is spaced from shaft axis A—A. Propeller 24 is rotatable—fully or partially—in a plane that is closely spaced to, and preferably parallel to, shaft axis A—A.

Figure 2:
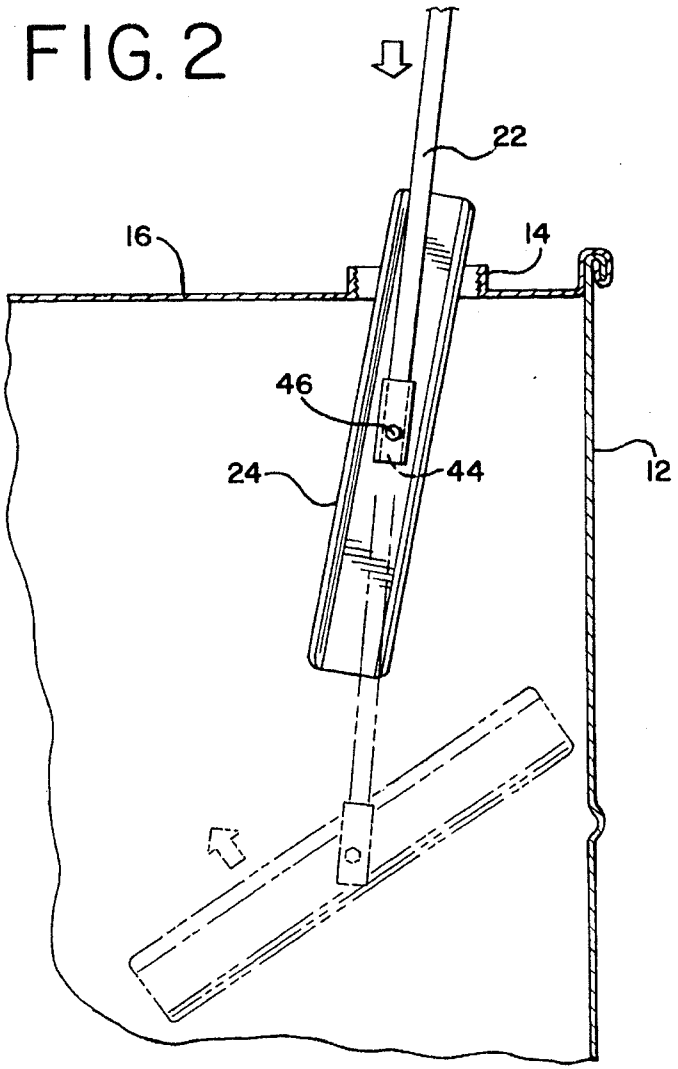
FIG. 2 is a partially-fragmented view of the drum shown in FIG. 1, on an enlarged scale, illustrating contemplated insertion of the propeller-fastened end of the mixing device shaft into an upper opening of the drum.

The pivotable nature of propeller 24 relative to shaft 22 readily enables an operator to align the elongated, one-piece propeller 24 with the elongated shaft 22, for purposes of inserting the propeller-equipped end of the portable mixing device 10 into opening 14 of drum 12, as is shown in FIG. 2.

The wrench 26 and the jam nut 28 are both carried by the container insert 20. In particular, the wrench 26 defines an annular surface 58 and has external threads 60 (FIG. 5) which are designed to threadedly engage the internal threads of container insert 20. (See FIGS. 3 and 4.)

The jam nut 28 defines an annular shoulder 62 (FIG. 5) which is rotatably abuttingly engageable by wrench annular surface 58; and jam nut 28 has internal threads which are designed to threadedly engage the external threads 63 (FIG.

5) of container insert 20 (see FIGS. 3 and 4), for the purpose of enabling the 55-gallon drum insert 20 to be brought into fluid-tight engagement with drum opening 14. For this purpose, an annular gasket or elastomeric washer 64 (FIG. 5) is so dimensioned as to snugly surround the external threads of container insert 20 while sandwiched between drum opening 14 and jam nut 28 atop drum opening 14. (See FIGS. 3 and 4.)

As mentioned above, wrench 26 has external threads 60 (FIG. 5) which are designed to threadedly engage the internal threads of container insert 20.

Jam nut 28 further defines internal threads (FIGS. 3 and 4) which are designed to threadedly engage the external threads 63 of container insert 20. Also, the annular shoulder 62 of jam nut 28 further includes an annular slot or groove into which is fitted an elastomeric O-ring 66 (FIG. 5) which annularly engagingly abuts wrench 26. (As is generally shown in FIGS. 3 and 4.)

Wrench 26 further includes a pair of spaced-apart, integral ears 68 and 70. (See FIGS. 1, 3 through 5.)

To assemble for operation, the internal threads of jam nut 28 are first rotated in a conventional manner (i.e. clockwise) onto the external threads 63 of container insert 20. Next, the external threads 60 of wrench 26 are then rotated in the conventional manner (i.e. again clockwise) into the internal threads (see FIGS. 3 and 4) of container insert 20, with the elastomeric O-ring 66 sandwiched between wrench 26 and jam nut 28 in the above-described annular slot or groove of jam nut 28.

Then, after the propeller-equipped end of shaft 22 has been disposed through drum opening 14 (FIG. 2) and while insert 20 is being disposed into drum opening 14, the external threads 63 of drum insert 20 are then rotated in the conventional manner into the internal threads of drum opening 14, while holding the annular gasket or elastomeric washer 64 to the annular underside surface of jam nut 28.

The presence of ears 68 and 70 on wrench 26, together with the co-operative relationship of wrench 26 and jam nut 28 with respect to the external threads 63 of insert 20, enable an operator to use simple hand pressure (applied e.g. by thumb and opposed forefinger) to secure the portable mixing device 10 in fluid-tight relationship to a conventional fluid container such as the illustrated 55-gallon drum 12.

As was briefly mentioned above, the elongated one-piece propeller 24 is rotatable about the axis A—A of shaft 22. In this regard, the disposition of axis A—A is displaced from true vertical, relative to drum 12, by 10 degrees or less. (See, e.g., U.S. Pat. No. 4,981,367 to Brazelton.)

In certain situations, it is desirable that the lower edge portion 56 (FIG. 5) of propeller 24 be rotated in a plane that is spaced slightly above the bottom end 18 (FIG. 1) of drum 12.

Crank 30 (FIGS. 1 and 5) is removably engageable with shaft 22 at the end portion 42 of shaft 22 where shaft 22 is rotatably fixed to insert 20 by inner shoulder 34 of insert 20 and spring clip 40 (FIGS. 3 and 4), enabling shaft 22 to be rotatable relative to drum insert 20 about shaft axis A—A.

An operator is thus able to use crank 30 to rotate propeller 24 in drum 12, as desired. For example, in certain situations, it may be desirable to rotate propeller 24 five (5) revolutions ("rpms") or less in drum 12.

While, in other situations, it may be desirable to rotate propeller 24 one-hundred and fifty (150) rpms or more in drum 12.

It is generally believed that an operator may be able to maintain rotation of propeller 24 relative to drum 12, most comfortably, at between forty-five (45) and ninety (90) rpms.

As was mentioned above, the upper end portion 42 of shaft 22 is non-circular, preferably square-shaped in transverse cross section.

Affixed to one end portion of crank 30 (such as by welding) is an apertured union 72. (FIGS. 4 and 5.) The aperture of the union 72 is so dimensioned as to longitudinally align with and snugly receive the upper end portion 42 of shaft 22. (FIG. 4.)

In this regard, an operator is able to use crank 30 to rotate propeller 24 in drum 12, for purposes of mixing the liquid contents of drum 12.

The aperture of union 72 is also dimensioned relative to the upper end portion 42 of shaft 22, so as to enable the union 72 of crank 30 to be readily removable from the upper end portion 42 of shaft 22, as desired. (FIG. 3.)

Vent cap 74 (FIG. 5) includes threads 76 designed to be readily rotatably engageable with, and readily removable from, the internal threads of wrench 26 (FIG. 3) when rotating vent cap 74 relative to wrench 26, for the purpose of enabling the drum 12 to be able to vent to atmosphere, as desired.

Vent cap 74 also includes spaced-apart integral ears 78. (FIG. 5.)

Vent cap ears 78 enable an operator to secure the vent cap 74 to the wrench 26, for e.g. drum-storage or drum-movement purposes, after the crank 30 has been removed from the shaft 22, by using simple hand pressure.

In particular, an operator, by using thumb and opposed forefinger, is readily able to engage the vent cap threads 76 with the inner threads of wrench 26, by rotating vent cap 74 relative to wrench 26 while the vent cap threads 76 are aligned with the inner threads of wrench 26.

What has been illustrated and described herein is a novel portable mixing device. However, while the mixing device of my invention has been illustrated and described with reference to a preferred embodiment, my present invention is not to be limited thereto. On the contrary, various mechanical alternatives as well as functional equivalents are certain to become apparent to those skilled in the art upon reading my foregoing description and referring to the accompanying drawing figures. Accordingly, all such mechanical alternatives and functional equivalents are to be considered as forming a part of my invention insofar as they fall within the spirit and scope of the accompanying claims.

I claim:

1. A portable mixing device for use with a fluid container having a threaded opening which defines internal threads, the portable mixing device comprising:

a container insert having internal threads and external threads, the external threads of the insert being mated to the internal threads of the fluid container opening, the external threads of the insert being removably engageable with the internal threads of the fluid container opening;

an elongated shaft rotatably carried by the insert, the shaft defining a shaft axis and having a first end portion that is non-circular in transverse cross section;

propeller means pivotally connected to a second end portion of the shaft, the second end portion of the shaft being opposite the first end portion of the shaft, the propeller means being pivotable about a pivot point that is spaced from the shaft axis, the propeller means being rotatable about the shaft axis;

wrench means and jam-nut means, both carried by the insert, the wrench means defining an annular surface, the wrench means further defining external threads which are mated to the internal threads of the insert, the jam-nut means defining an annular shoulder engageable by the wrench means annular surface, the jam nut means further defining internal threads which are mated to the external threads of the insert, for bringing the insert into fluid-tight engagement with the container opening; and crank means removably engageable with the shaft proximate to the insert, for rotating the shaft about the shaft axis.

2. The portable mixing device of claim 1 wherein the wrench means further includes internal threads, and wherein the portable mixing device further comprises vent means carried by the wrench means, the vent means having external threads which are mated to the internal threads of the wrench means, for enabling the container to vent to atmosphere.

3. The portable mixing device of claim 1 wherein the container insert defines a through bore having an inner circumferential portion, wherein the shaft is removably disposed in the insert through bore, and wherein the portable mixing device further comprises:

bearing means carried by the shaft and having a circumferential portion that is rotatably engageable with the inner circumferential portion of the insert through bore, for enabling the shaft to be rotated about the shaft axis relative to the insert; and lock-ring means carried by the insert for retaining the bearing means in the insert through bore.

4. The portable mixing device of claim 1 wherein the fluid container is a 55-gallon drum, wherein the crank means is human powered, and wherein the shaft rotates between 5 and 150 revolutions per minute about the shaft axis.

5. In combination with a fluid-containing vessel having an internally-threaded opening, a portable mixing device disposable into the vessel opening for mixing fluid contained within the vessel, wherein the portable mixing device comprises:

a vessel insert having internal threads and external threads, the external threads of the insert being mated to the internal threads of the vessel opening and the external threads of the insert being removably engaged by the internal threads of the vessel opening;

an elongated shaft rotatably carried by the insert, the shaft defining a shaft axis and having a first end portion that is non-circular in transverse cross section;

propeller means pivotally connected to a second end portion of the shaft, the second end portion of the shaft being opposite the first end portion of the shaft, the propeller means being pivotable about a pivot point that is spaced from the shaft axis, the propeller means being rotatable about the shaft axis;

wrench means and jam-nut means, both carried by the insert, the wrench means defining an annular surface, the wrench means further defining external threads which are mated to the internal threads of the insert, the jam-nut means defining an annular shoulder engageable by the wrench means annular surface, the jam nut means further defining internal threads which are mated to the external threads of the insert, for bringing the insert into fluid-tight engagement with the vessel opening; and crank means engageable with the shaft proximate to the insert, for rotating the shaft about the shaft axis.

6. The combination of claim 5 wherein the wrench means further includes internal threads, and wherein the portable mixing device further comprises vent means carried by the wrench means, the vent means having external threads which are mated to the internal threads of the wrench means, for enabling the vessel to vent to atmosphere.

7. The combination of claim 5 wherein the vessel insert defines a through bore having an inner circumferential portion, wherein the shaft is removably disposed in the insert through bore, and wherein the portable mixing device further comprises:

bearing means carried by the shaft and having a circumferential portion that is rotatably engageable with the inner circumferential portion of the insert through bore, for enabling the shaft to be rotated about the shaft axis relative to the insert; and lock-ring means carried by the insert for retaining the bearing means in the insert through bore.

8. The combination of claim 5 wherein the vessel is a 55-gallon drum, wherein the crank means is human powered, and wherein the shaft rotates between 5 and 150 revolutions per minute about the shaft axis.

* * * * *